US005791489A

United States Patent [19]

Leifeld

[11] Patent Number: 5,791,489

[45] Date of Patent: Aug. 11, 1998

[54] APPARATUS FOR SEPARATING FOREIGN BODIES FROM A FIBER TUFT STREAM

[75] Inventor: Ferdinand Leifeld, Kempen, Germany

[73] Assignee: Trützschler GmbH & Co. KG, Mönchengladbach, Germany

[21] Appl. No.: 642,306

[22] Filed: May 3, 1996

[30] Foreign Application Priority Data

May 5, 1995 [DE] Germany ..... 195 16 569.1

[51] Int. Cl.[6] ..... B07C 5/00

[52] U.S. Cl. ..... 209/44.1; 209/44.2; 209/567; 209/639

[58] Field of Search ..... 209/12.1, 44.1, 209/44.2, 567, 638, 639, 644, 657; 19/200, 204, 205

[56] References Cited

U.S. PATENT DOCUMENTS

| | | | |
|---|---|---|---|
| 4,657,144 | 4/1987 | Martin et al. | 209/639 X |
| 5,626,237 | 5/1997 | Hergeth | 209/644 X |

FOREIGN PATENT DOCUMENTS

| | | |
|---|---|---|
| 0 530 934 | 3/1993 | European Pat. Off. . |
| 26 55 426 | 1/1978 | Germany . |
| 81 35 338 | 7/1982 | Germany . |
| 36 44 535 | 7/1988 | Germany . |
| 38 43 602 | 7/1990 | Germany . |
| 284 911 | 11/1990 | Germany . |
| 39 24 566 | 2/1991 | Germany . |
| 90 17 759 | 2/1992 | Germany . |
| 40 17 129 | 10/1992 | Germany . |
| 619 991 | 10/1980 | Switzerland . |

*Primary Examiner*—David H. Bollinger
*Attorney, Agent, or Firm*—Spencer & Frank

[57] ABSTRACT

An apparatus for detecting foreign substances in a fiber tuft stream and for separating the foreign substances therefrom, includes a conduit guiding the fiber tuft stream therethrough in a conveying direction; a metal detector situated at a first location of the conduit for detecting a metal substance in flight and for emitting signals representing the metal substance; a first separating device situated at a second location of the conduit downstream of the first location as viewed in the conveying direction; a first control device connected to the metal detector and the first separating device for operating the first separating device in response to a signal emitted by the metal detector for removing the detected metal substance; an optical sensor situated at a third location of the conduit for detecting a non-metal substance in flight and for emitting signals representing the non-metal substance; a second separating device situated at a fourth location of the conduit; a second control device connected to the optical sensor and the second separating device for operating the second separating device in response to a signal emitted by the optical sensor for removing the detected non-metal substance.

17 Claims, 4 Drawing Sheets

APPARATUS FOR SEPARATING FOREIGN BODIES FROM A FIBER TUFT STREAM

CROSS REFERENCE TO RELATED APPLICATION

This application claims the priority of German Application No. 195 16 569.1 filed May 5, 1995, which is incorporated herein by reference.

BACKGROUND OF THE INVENTION

This invention relates to an apparatus for separating foreign bodies, for example, metal parts from a fiber transporting duct in a fiber processing line. The duct has a branch-off location provided with a deflecting (separating) mechanism for the foreign substances. A metal detector is situated upstream of the branch-off location as viewed in the advancing direction of the fiber tufts. The deflecting (separating) mechanism and the metal detector are coupled with a control device in such a manner that the branch-off location, as a result of the passage of a metal object through the zone of the metal detector, is placed into the deflecting position. The fiber tufts are advanced to the separating mechanism by gravity.

An apparatus of the above-outlined type is disclosed, for example, in German Offenlegungsschrift (application published without examination) No. 41 29 882.

SUMMARY OF THE INVENTION

It is an object of the invention to provide an improved apparatus of the above-outlined type which permits in a simple manner the recognition and separation of non-metallic parts such as pieces of fabric, bands, strings, sheet parts and the like from the fiber tuft stream.

This object and others to become apparent as the specification progresses, are accomplished by the invention, according to which, briefly stated, the apparatus for detecting foreign substances in a fiber tuft stream and for separating the foreign substances therefrom, includes a conduit guiding the fiber tuft stream therethrough in a conveying direction; a metal detector situated at a first location of the conduit for detecting a metal substance in flight and for emitting signals representing the metal substance; a first separating device situated at a second location of the conduit downstream of the first location as viewed in the conveying direction; a first control device connected to the metal detector and the first separating device for operating the first separating device in response to a signal emitted by the metal detector for removing the detected metal substance; an optical sensor situated at a third location of the conduit for detecting a non-metal substance in flight and for emitting signals representing the non-metal substance; a second separating device situated at a fourth location of the conduit; a second control device connected to the optical sensor and the second separating device for operating the second separating device in response to a signal emitted by the optical sensor for removing the detected non-metal substance.

Thus, according to the invention, the fiber tufts are inspected during their free fall for non-metallic foreign substances. When such substances are detected, they are, during their free fall, separated from the fiber tufts. Or, if such foreign bodies are free from fiber tufts in the fiber tufts stream, they are separated individually. By virtue of the fact that the fiber tufts are advanced by gravity, an additional conveyor device may be dispensed with, resulting in a particularly simple construction. According to the invention, non-metal foreign bodies are detected and separated which are on or in the fiber tufts. Non-metal foreign bodies, however, which are externally of the fiber tufts are also detected and separated. By means of the apparatus according to the invention the following exemplary types of foreign substances may be reliably recognized and separated: plastic sheet parts, pieces of fabric made of plastic films, jute or cotton, meshed pieces, plastic, jute or cotton strings, pieces of colored polypropylene sheets or the like, oily fiber tufts and also pieces having a higher specific weight, such as pebbles, seeds and the like. As a result, operational disturbances during further processing of the fiber tufts, for example, wear of clothing, malfunctions in the machinery, thread breakages, interference with the coloring and the like are significantly reduced.

DESCRIPTION OF THE PREFERRED EMBODIMENTS

Figure 1:
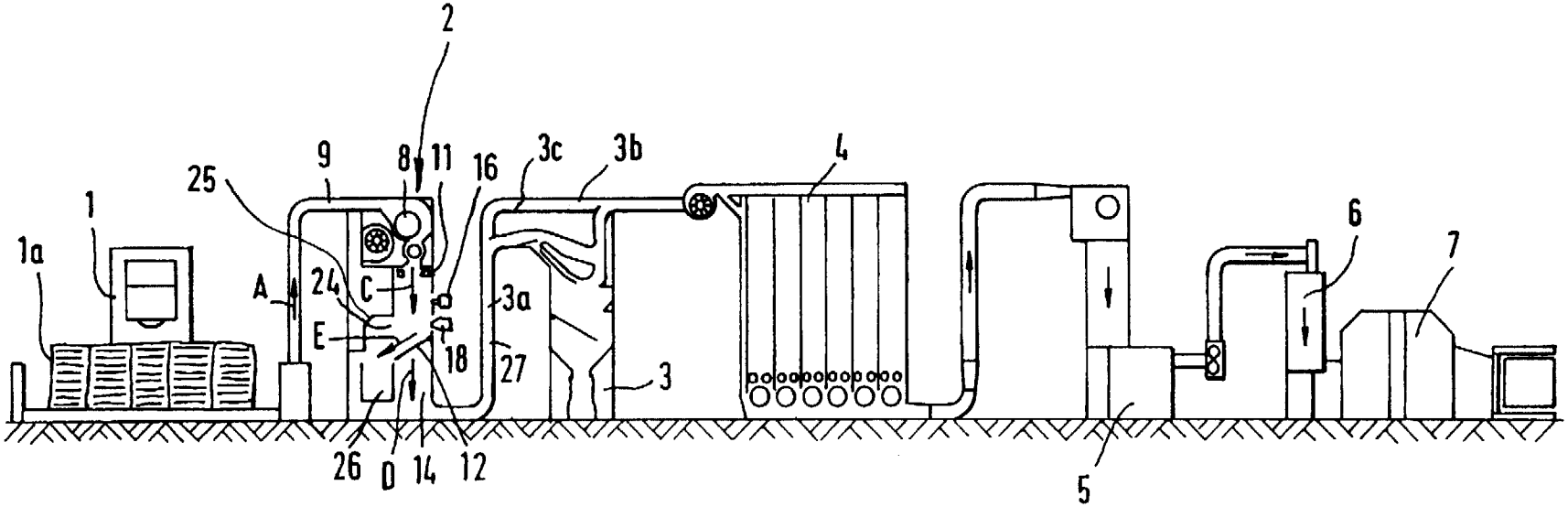
FIG. 1 is a schematic side elevational view of a fiber tuft processing line including the apparatus according to the invention.

FIG. 1 shows a fiber processing (cleaning) line in which an apparatus 2 according to the invention is arranged between a bale opener 1 which may be a BLENDOMAT BDT model manufactured by Trützschler GmbH & Co. KG, Mönchengladbach, Germany and a multimixer 4. Downstream of the apparatus 2, as viewed in the advancing direction of the fibers, a heavy particle separator 3 is disposed. Downstream of the multimixer 4 a fine opener 5 as well as card feeders 6 (only one shown) each associated with a respective carding machine 7 (only one shown) are arranged. The fiber bale series worked on by the bale opener 1 is designated at 1*a*. A condenser 8, having a sieve drum, is disposed in the apparatus 2 and is coupled with the bale opener 1 by a pneumatic duct 9. A chute 14 of the apparatus 2 as well as the other downstream-arranged machines are interconnected with pneumatic ducts. Between the condenser 8 and the chute 14, however, no pneumatic transporting force is present.

An inductive coil 11, functioning as a metal detector, is arranged vertically below the condenser 8 at the upstream end of the chute 14. The fiber material drops from the condenser 8 through the coil 11 in a free fall through the substantially vertically oriented chute 14 as indicated by the arrow C. Between a guide plate 25 and the chute 14 a passage 24 is provided which faces a pivotal gate 12. Laterally of the chute 14 and underneath the passage 24 an upwardly open waste container 26 is positioned. As soon as the gate 12 is switched in response to a signal generated by the detector coil 11 indicating the passage of a metal body, the fiber material, together with the foreign body is deflected into the container 26 as indicated by the arrow E.

The heavy particle separator 3 which may be, for example, a SEPAROMAT model, manufactured by Tr ützschler GmbH & Co. KG and which adjoins the apparatus 2 in a downstream direction, has an inlet conduit 3a connected at its end to a branch conduit 3b. The flow rate in the branch conduit 3b may be adjusted by a throttle 3c as a function of the air quantities flowing through the inlet channel 3a. The inlet conduit 3a constitutes a rising pneumatic transport duct between the apparatuses 2 and 3.

Figure 2:
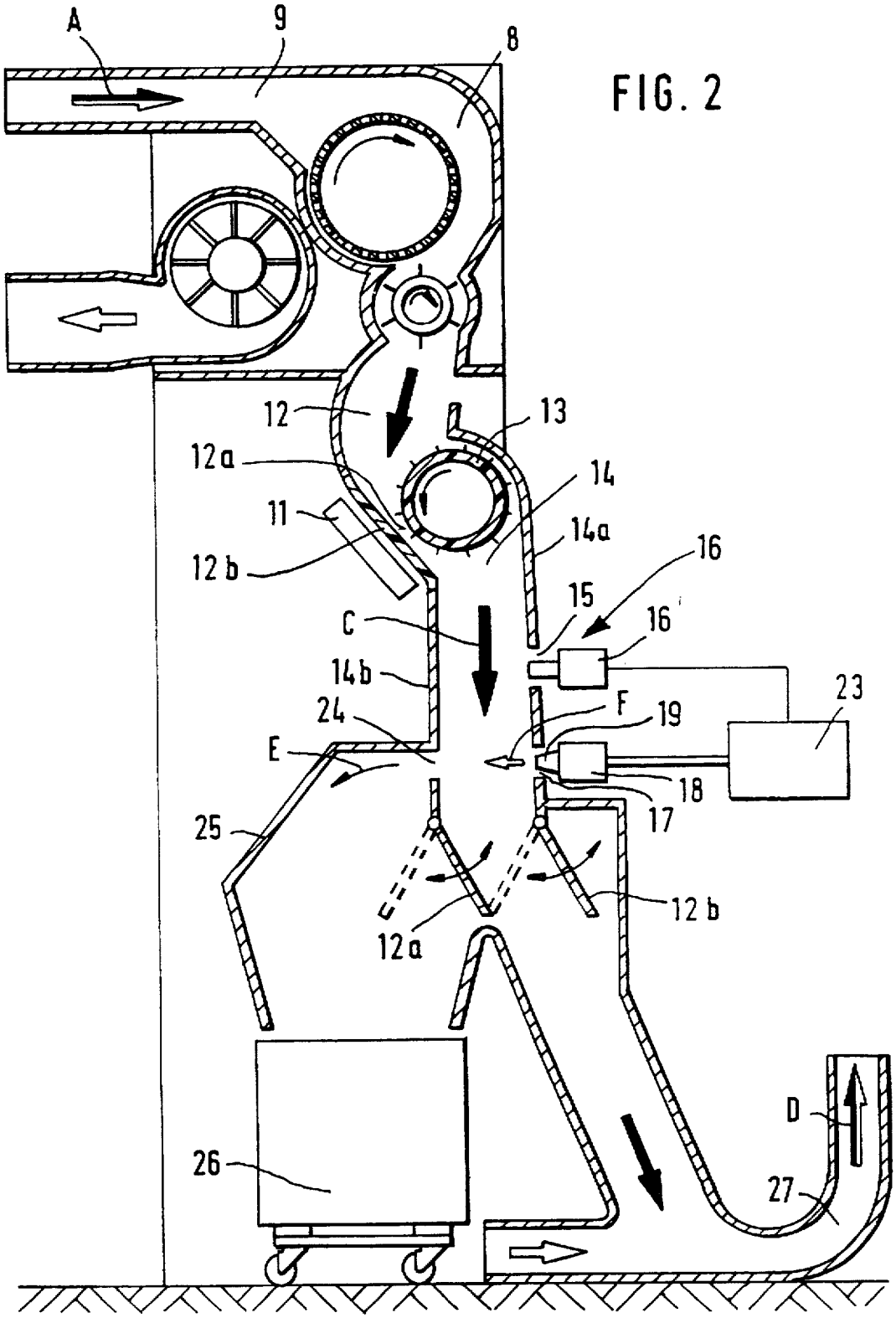
FIG. 2 is a sectional side elevational view of a preferred embodiment of the invention.

Turning to FIG. 2, between the condenser 8 and the chute 14 a curved fiber tuft guiding conduit 12 is provided in which a roll 13 (which may be a plastic roll with webs) is positioned. The fiber material is advanced downwardly into the chute 14 through a clearance 12a defined between the roll 13 and the oppositely lying plastic wall portion 12b of the conduit 12. A metal detector plate 11, including inductive detector coils, is situated externally of the wall portion 12b, adjacent the clearance 12a. The fiber material containing metal foreign bodies is deflected into the waste container 26 by a dual plate assembly 12a, 12b switched into its deflecting position in response to a signal generated by the detector plate 11 upon passage of the metal body.

Underneath the detector plate 11, in a wall 14a of the chute 14, an opening 15 is provided through which an optical sensor system 16, for example, a camera 16' is directed towards the downwardly-advancing fiber tufts C. In case the camera 16' is a diode line camera, it may monitor the opened fiber tufts C through the opening 15 over the width a of the chute 14. The camera 16' may be of the type which takes an entire image. The camera may work with different lights of the light spectrum, such as normal light, ultraviolet light or infrared light.

Figure 5:
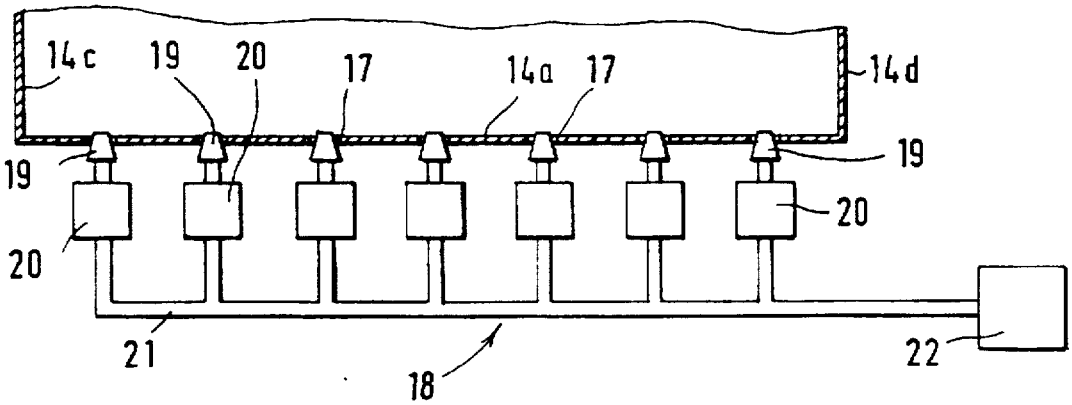
FIG. 5 is a schematic sectional top plan view of a pneumatic blow-out device including a series of blow nozzles according to the invention.

Also referring to FIG. 5, underneath the opening 15 in the chute wall 14a a row of openings 17 is in alignment with respective nozzles 19 of a blow-out device 18. Each nozzle 19 which is controlled by a respective valve 20 is directed transversely to the advancing direction of the fiber tuft in the chute 14. The valves 20 are connected by a conduit 21 to a pressure conduit 22. The sensor system 16 and the blow-out device 18 are connected to an electronic control and regulating device 23. The opening 24 in the chute wall 14b faces the blow-out device 18 and is associated with a baffle plate 25. The foreign substances E move through the passage 24 into the container 26, blown by the air stream F emanating from the actuated nozzles 19. It will be understood that instead of blow nozzles, suction nozzles may be used to create a vacuum stream for separating the articles detected by the optical sensor system 16.

The cleaned fiber tufts D are pneumatically transported through a conduit 27 and the conduit 3a to the successive fiber processing machine.

Figure 3:
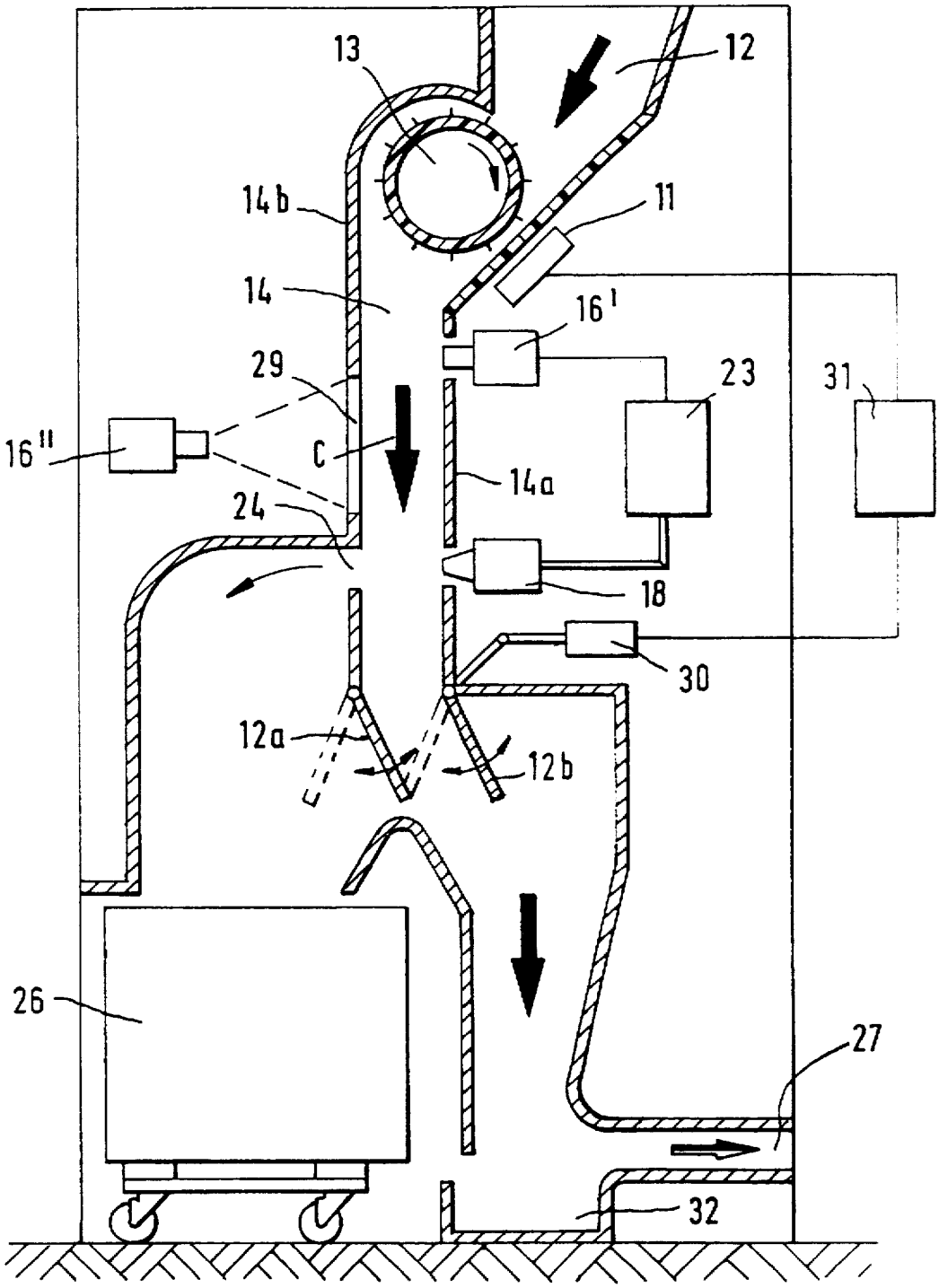
FIG. 3 is a sectional side elevational view of another preferred embodiment of the invention.

Turning to FIG. 3, in the chute wall 14b an additional opening 29 is provided which is aligned with an additional camera 16" which is offset in the downstream direction relative to the camera 16' and which monitors the fiber tuft stream in the chute 14 through the opening 29. The metal detector plate 11 and a pneumatic setting device 30, such as a pressure cylinder for the dual gate assembly 12a, 12b are connected to an electronic control and regulating device 31. The electronic control and regulating devices 23 (FIG. 2) and 31 (FIG. 3) may be electrically connected with one another or combined into a single apparatus. Underneath the chute 14 a waste container 32 is provided for heavy parts such as stones, pieces of wood or the like.

During normal operation of the apparatus shown in FIGS. 2 and 3, the blow-out device 18 is inoperative and the dual gates 12a and 12b are in their solid-line position in which the fiber material is admitted into the pneumatic duct 27. In case a metal object is detected by the metal detector 11, the gates 12a, 12b are pivoted into their dotted-line position in FIGS. 2 and 3 and, as a result, the material stream, containing the metal body, is deflected into the waste container 26. In case a foreign body is detected by the optical sensor system formed of the camera 16' and/or 16", the blow-out device 18 is activated by the control device 23 for pneumatically removing the detected foreign substance from the stream through the discharge opening 24 provided in the wall 14b into the waste container 26.

Figure 4:
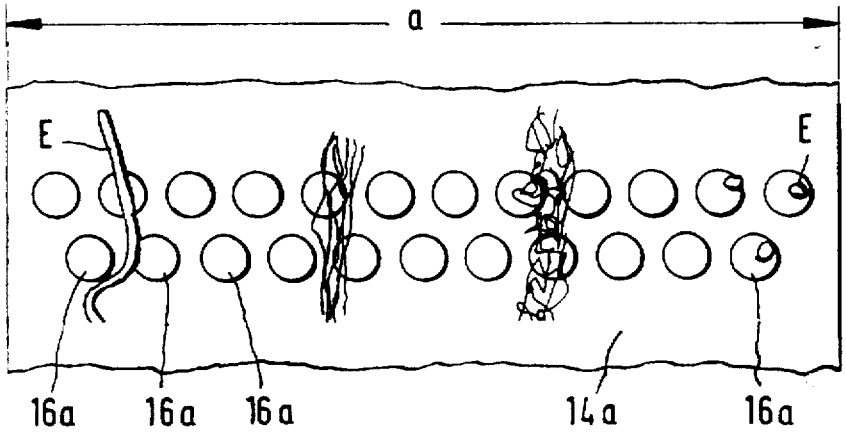
FIG. 4 is a schematic side elevational view of a sensor system including a plurality of sensors according to the invention.

According to FIG. 4, the optical sensor system 16 is formed of two superposed rows of optical sensor elements 16a, such as color sensor elements provided on the vertical chute wall 14a along the entire width a of the chute 14.

Figure 6:
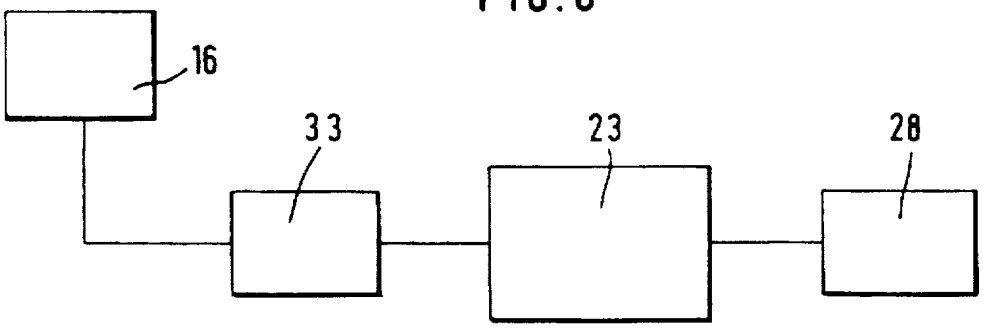
FIG. 6 is a block diagram of an electronic control and regulating device connected to a sensor system, an image processing device and a valve control for the blow-out nozzles.

As shown in the block diagram of FIG. 6, the optical sensor system 16, an image processing device 33 and a valve control 28 for the valves 20 are connected to the electronic control and regulating device 23. The electronic control and regulating device 23 associated with the air-stream generating device 18 and the electronic control and regulating device 31 associated with the metal detector 11 may be electrically connected with one another or may be combined into a single electronic control and regulating device.

It will be understood that the above description of the present invention is susceptible to various modifications, changes and adaptations, and the same are intended to be comprehended within the meaning and range of equivalents of the appended claims.

What is claimed is:

1. An apparatus for detecting foreign substances in a fiber tuft stream and for separating the foreign substances therefrom, comprising (a) a conduit guiding the fiber tuft stream therethrough in a conveying direction;

(b) metal detector means situated at a first location of said conduit for detecting a metal substance in flight and for emitting signals representing said metal substance;

(c) first separating means situated at a second location of said conduit downstream of said first location as viewed in the conveying direction;

(d) first control means connected to said metal detector means and said first separating means for operating said first separating means in response to a signal emitted by said metal detector means for removing the detected metal substance;

(e) optical sensor means situated at a third location of said conduit for detecting a non-metal substance in flight and for emitting signals representing said non-metal substance;

(f) second separating means situated at a fourth location of said conduit downstream of said third location as viewed in the conveying direction; and (g) second control means connected to said optical sensor means and said second separating means for operating said second separating means in response to a signal emitted by said optical sensor means for removing the detected non-metal substance.

2. The apparatus as defined in claim 1, wherein said optical sensor means is arranged externally of said conduit and further wherein said conduit is provided, at said third location, with a light-transparent opening to transmit light for said optical sensor means.

3. The apparatus as defined in claim 1, wherein said conduit has an inner width dimension measured perpendicularly to said conveying direction and further wherein said optical sensor means includes a plurality of optical sensor elements arranged over said inner width dimension.

4. The apparatus as defined in claim 1, wherein said third and fourth locations are flanked by said first and second locations.

5. The apparatus as defined in claim 1, wherein said conduit is substantially vertically oriented from said first location for effecting a free fall of the fiber tufts by gravity.

6. The apparatus as defined in claim 1, wherein said conduit includes, downstream of said metal detector means, first and second walls facing one another; further wherein said optical sensor means comprises a first optical system arranged at said first wall and a second optical system arranged at said second wall.

7. The apparatus as defined in claim 1, further comprising pneumatic means for advancing fiber tufts, freed of foreign metal and non-metal substances, from said conduit with a conveying air stream.

8. The apparatus as defined in claim 1, wherein said first separating means includes a branch channel extending from said conduit at said second location; a gate having an actuated position in which the fiber tufts and the detected metal substance are directed into said branch channel; and gate displacing means for moving said gate into said actuated position.

9. The apparatus as defined in claim 8, wherein said metal detector means and said gate actuating means are connected to said first control means; said first control means including an electronic control and regulating device.

10. The apparatus as defined in claim 1, further comprising a device connected to said conduit downstream of said second and third locations for separating heavy foreign bodies from said fiber tuft stream.

11. The apparatus as defined in claim 10, wherein said conduit is substantially vertically oriented from said first location for effecting a free fall of the fiber tufts by gravity; said device being positioned underneath said second location.

12. The apparatus as defined in claim 1, wherein said second separating means comprises an air-stream generating device emitting an air stream transversely to said conveying direction; said conduit including an opening at said fourth location for allowing passage of said air stream from said conduit.

13. The apparatus as defined in claim 12, wherein said opening is in communication with said waste conduit; further comprising a waste collecting device connected to said waste conduit for receiving separated metal and non-metal substances.

14. The apparatus as defined in claim 12, wherein said conduit has an inner width dimension measured perpendicularly to said conveying direction and further wherein said air-stream generating device comprises a plurality of blow nozzles arranged over said inner width dimension.

15. The apparatus as defined in claim 12, wherein said first control means includes a first electronic control and regulating device and said second control means includes a second electronic control and regulating device; further comprising valve means for operating said air-stream generating device, and valve control means for controlling said valve means; said optical sensor means, said evaluating means and said valve control means being connected to said second electronic control and regulating device.

16. The apparatus as defined in claim 15, wherein said first and second electronic control and regulating devices are electrically connected to one another.

17. The apparatus as defined in claim 15, wherein said first and second electronic control and regulating devices are combined into a single electronic control and regulating device.

* * * * *